United States Patent [19]

Cunningham

[11] Patent Number: 4,689,470

[45] Date of Patent: Aug. 25, 1987

[54] SELF-REGULATING BASEBOARD HEATER, SYSTEM AND METHOD

[75] Inventor: Donald M. Cunningham, Allegheny County, Pa.

[73] Assignee: Emerson Electric Co., St. Louis, Mo.

[21] Appl. No.: 829,943

[22] Filed: Feb. 18, 1986

[51] Int. Cl.[4] ..... H05B 3/10

[52] U.S. Cl. ..... 219/213; 219/341; 219/505; 219/549; 338/212; 338/214

[58] Field of Search ..... 219/341, 505, 549, 548, 219/213, 345, 378; 338/212, 214, 223

[56] References Cited

U.S. PATENT DOCUMENTS 3,657,516 4/1972 Fujihara ..... 219/213

4,334,148 6/1982 Kampe ..... 219/548

4,543,474 9/1985 Horsma et al. ..... 219/548

*Primary Examiner*—Roy N. Envall, Jr.

*Attorney, Agent, or Firm*—Polster, Polster and Lucchesi

[57] ABSTRACT

A self-regulating heat producing strip is disposed along each wall of a room. The strip includes at least one pair of spaced apart electrical conductors extending longitudinally along the base of at least one wall and spaced therefrom. Self-limiting conductive material is in physical contact with and forms a heat generating zone between the conductors. An electrically insulated jacket longitudinally covers the conductors and the self-limiting conductive material. Connectors are provided for connecting the conductors to a power source to generate heat in the heat generating zone between the conductors.

6 Claims, 4 Drawing Figures

SELF-REGULATING BASEBOARD HEATER, SYSTEM AND METHOD

BACKGROUND OF THE INVENTION

This inventioh relates to heating systems for individual rooms and the like and more particularly to self-regulating baseboard heater systems.

Various devices and apparatus have been devised to maintain the temperature of a closed volume such as a room in a home, an office, or the like at a predetermined value. Radiators, space heaters, baseboard heaters, and the like have all been developed for such purposes.

Placement of these various types of heaters is influenced by the fact that the total heat loss from such a space consists of losses through windows and doors primarily and secondarily through the walls, ceiling and floor of the room. Such heaters are therefore usually placed near the floor adjacent the windows and, to a much leser extent, near the doors. Since the losses through outside walls tend to be much greater than through other walls, prior baseboard heaters have been positioned almost exclusively on outside walls.

Baseboard heaters in common use have an elongated, finned metal sheath electric heating element, a channel-shaped front wall which shields the heating element from outside objects, interior baffles to limit the temperature of exposed parts of the heater, a back wall which is generally mounted flush against a building wall, and two end walls. Such heaters perform well, but they could be improved. For example, it would be desirable to decrease the cost of currently available baseboard heaters. Present baseboard heaters are also relatively complicated to install. And their appearance sometimes detracts from the appearance of a room. In addition, the presence of baseboard heaters has heretofore limited the placement of objects such as furniture in a room because the presence of such an object in front of a baseboard heater would block the heat from the heater. At present, baseboard heaters are placed near those structures which are predicted to have the greatest heat loss, such as windows and the outside walls, because this improves the comfort of people in the room. However, if the heat loss is significant at some point in the room other than where the baseboard heater is placed, the comfort of the user is greatly reduced. Present baseboard heaters also cause "wall streaking." The surface and air temperatures of these heaters are so high that dust and other air-borne particles can be carbonized by the heater and deposited as streaks of soot above the heater.

SUMMARY OF THE INVENTION

Among the various objects and features of the present invention may be noted the provision of a baseboard heating system which is low in cost.

A second object of the present invention is the provision of a baseboard heating system which is relatively easy to install.

A third object of the present invention is the provision of a baseboard heating systyem with improved appearance.

A fourth object of the present invention is the provision of a baseboard heating system which permits the placement of furniture and the like anywhere in the room.

A fifth object of the present invention is the provision of a baseboard heating system which provides improved comfort for any occupant of the room.

A sixth object of the present invention is the provision of a baseboard heating system with lower surface and air temperatures which thereby reduces or eliminates wall streaking caused by carbonized air particles.

Other objects and features will be in part pointed out and in part apparent to those skilled in the art in light of the following description and accompanying drawings.

Briefly, the method of the present invention is applicable to any room such as a room in a house or an office in a commercial building. The method includes the steps of disposing a self-regulating heat producing strip along each wall of the room and applying a voltage to the strip to generate heat in the strip. The strip includes at least one pair of spaced apart electrical conductors extending longitudinally along each wall and spaced therefrom. Self-limiting conductive material is in physical contact with and forms a heat generating zone between the conductors. An electrically insulative jacket longitudinally covers the conductors and the self-limiting conductive material. A voltage is applied across the conductors to generate heat in the strip.

The baseboard heating system of the present invention includes a self-regulating heat producing strip disposed along each wall of a room. The strip extends substantially the entire length of the base of each wall. It includes at least one pair of spaced apart electrical conductors extending longitudinally along at least one wall and spaced therefrom. Self-limiting conductive material is in physical contact with and forms a neat generating zone between the conductors. An electrically insulative jacket longitudinally covers the conductors and the self-limiting conductive material. Means are provided for connecting the conductors to a power source.

In a first embodiment a self-regulating baseboard heater of the present invention includes a self-regulating heat producing strip. The strip includes a plurality of pairs of spaced apart electrical conductors longitudinally extending substantially the entire length of the strip. Self-limiting conductive material is in physical contact with and forms a heat generating zone at least between each pair of conductors. An electrically insulative jacket longitudinally covers the conductors and the self-limiting conductive material, whereby application of a voltage across the pairs of conductors results in the generation of a self-regulated heat output along the strip.

In a second embodiment a self-regulating baseboard heater of the present invention includes a strip of self-regulating heat producing material having a heat output of at least approximately fifty watts per foot. The strip includes at least one pair of spaced apart electrical conductors longitudinally extending substantially the entire length of the strip. Self-limiting conductive material is in physical contact with and forms a heat generating zone between the conductors. An electrically insulative jacket longitudinally covers the conductors and the self-limiting conductive material. The strip is severable at any point along its length to expose the electrical conductors for connection to a power source.

BRIEF DESCRIPTION OF THE DRAWINGS

Similar reference characters indicate similar parts throughout the several views of the drawings.

DESCRIPTION OF THE PREFERRED EMBODIMENT

Figure 1:
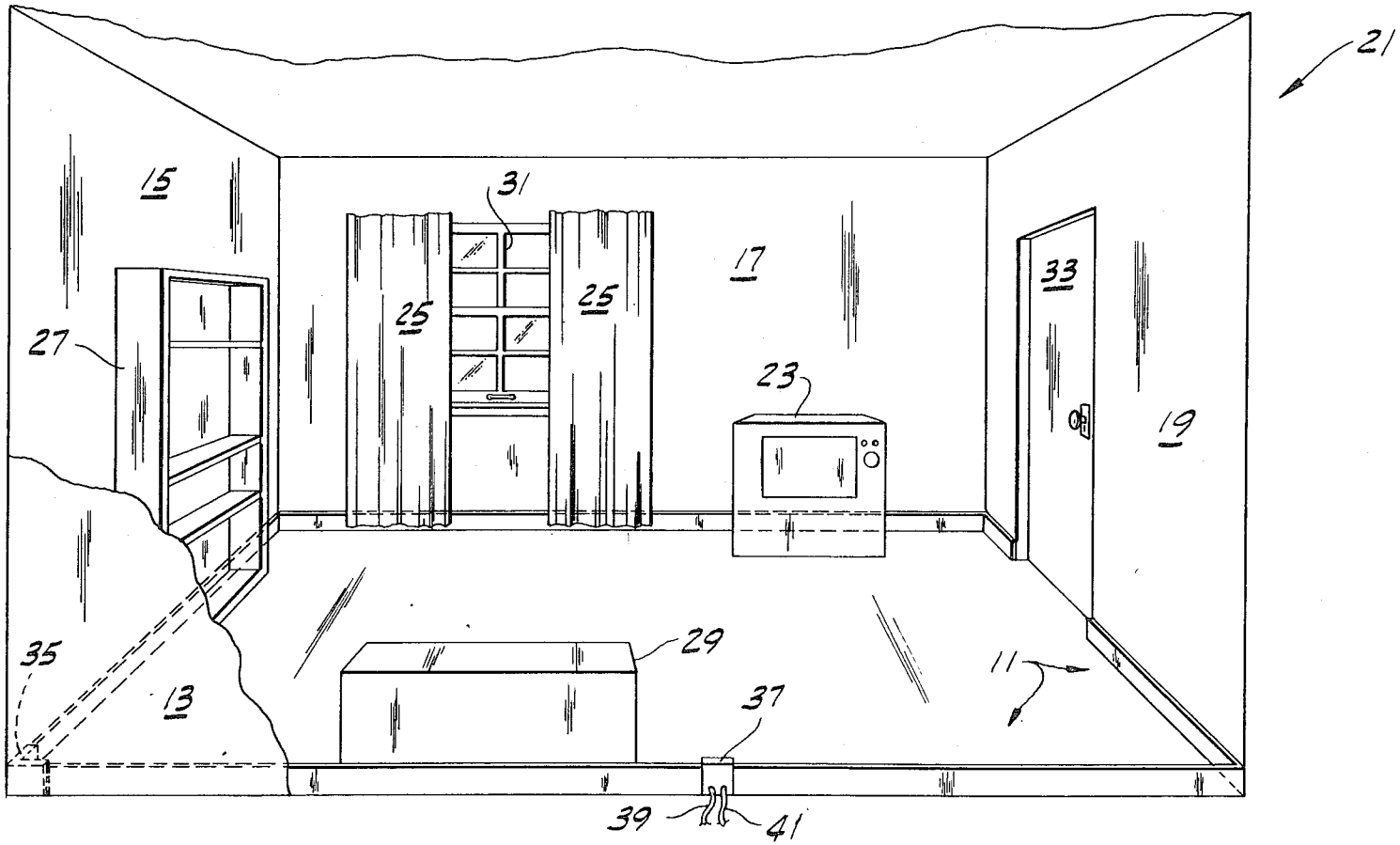
FIG. 1 is a perspective view showing a baseboard heating system of the present invention.

A self-regulating baseboard heater 11 of the present invention is shown secured to the walls 13, 15, 17 and 19 of a room 21. The heater is a strip of self-regulating heat producing material disposed along the base of each wall in place of a decorative baseboard strip. The heater is preferably from approximately one-eighth to approximately one-quarter inch in width and approximately two and one-half inches to six inches in height, so it closely resembles the decorative baseboard which it replaces. The strip, as will be seen below, includes at least one pair of spaced apart conductors over which is extruded a self-limiting conductive material. Such material is known. For example, U.S. Pat. No. 2,978,665 to Vernet et al and U.S. Pat. No. 2,861,163 to Asakawa disclose such material as a two-phase, carbon black-filled, self-temperature regulating material incorporating a "thermally expansible" component, such as polyethylene and a "flow preventing" component which is solid in the transition temperature range of the expansible material. The use of such materials for heating cables which are used in freeze protection of pipes and for maintaining the flow of viscous syrups, for example, is known. However, heretofore it is not believed to have been known that this material, when incorporated into a suitable strip structure could be used for baseboard heating. For example, it is believed that the structure of previously available heating cables was incapable of satisfactorily supplying sufficient heat (for example, fifty to 150 watts per foot of strip) to function as a baseboard heater.

Heater or strip 11 of the present invention has the property, because of the self-limiting nature of its material, that its heat generation is reduced in those locations where the strip is covered by an object such as a television 23, draperies 25, a bookcase 27, or another piece of furniture 29. That is, where the heat loss in the room is reduced, the heat generated by strip 11 at that point is reduced proportionally. Simiarly, in those locations where greater heat loss is in fact taking place, such as might occur directly under the window 31 and by a door 33, the heat output of strip 11 is increased. In fact, strip 11 automatically compensates for any variance in the heat loss around the room by adjusting its heat output at that point accordingly. This feature augments the normal room thermostat control and improves the comfort of any occupant of the room.

Even though the heat output of the strip 11 is a relatively low fifty to 150 watts per foot, that can be sufficient to heat room 21 since, unlike many baseboard heaters, strip 11 extends completely around room 21.

Strip 11 is relatiely flexible so that it may be shipped to a construction site in coils containing a hundred feet or more of strip. As much strip as is needed is then uncoiled from the coil and glued or otherwise suitably attached to the base of each wall in the room. Strip 11 is severable at any point along its length, so one coil can be used for several rooms without any wastage. Depending upon the size of the wires in strip 11 and the desired ornamental effect, it may be necessary to form strip 11 from several strip segments which are electrically connected together. For example, this sort of construction is shown in the corner between walls 13 and 15 where a connector block 35 connects the strip portion along wall 13 with that of wall 15. Electrical connection between strip 11 and the wiring of the home or building can be made with connector block 35. Alternatively, a connector block 37 whose primary purpose is to make such electrical connections may be used. Block 37, for example, includes a pair of insulated wires 39 and 41 for making electrical connection with the home wiring in a junction box or the like (not shown).

Because strip 11 is severable at any location along its length, the system of the present invention is extremely flexible. Connector blocks 37 and 35 can be spliced into strip 11 in as many or as few locations as needed. Moreover, strip 11 can be used in rooms of any size, since a coil of strip 11 can readily be cut aong its length to fit the particular room in which it is being installed.

Figure 2:
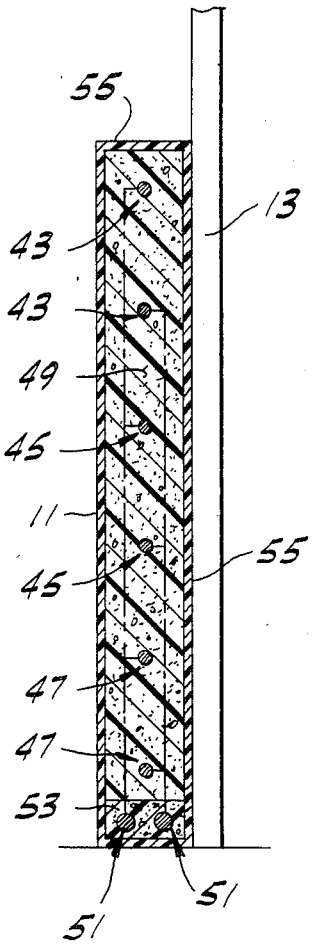
FIG. 2 is a cross-sectional view on an enlarged scale of the baseboard of the present invention secured to a wall.

Strip 11 has a relatively flat back as shown in FIG. 2 so that it may be suitably secured as by suitable adhesive to a wall such as wall 13 shown in FIGS. 1 and 2. Although the strip is preferably disposed along the base of the wall, it can of course be disposed in other places as the heating needs of the particular room require.

Figure 3:
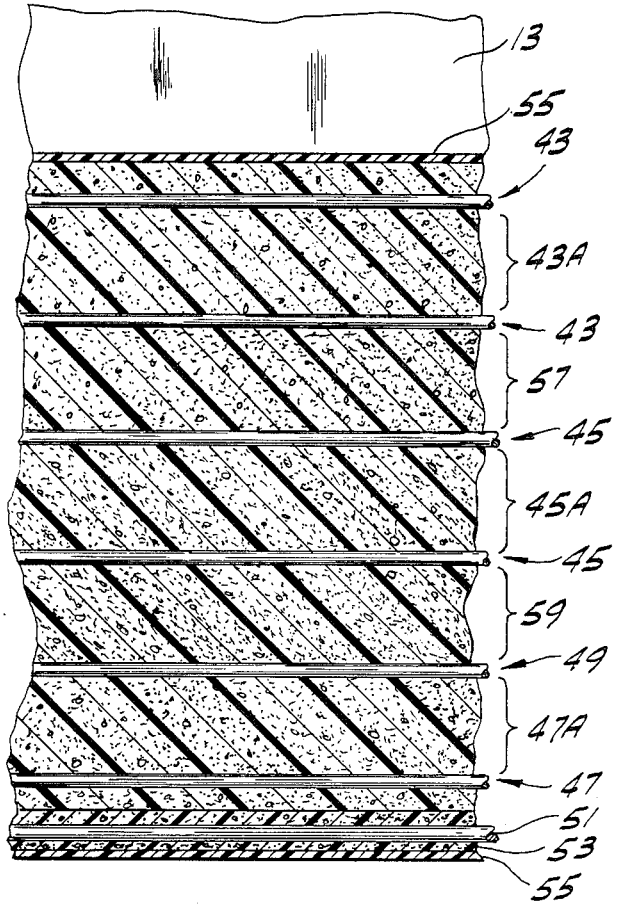
FIG. 3 is a cross-sectional view on an enlarged scale illustrating the construction of one embodiment of the baseboard heater of the present invention.

Strip 11 has generally an identical cross section throughout its entire length, which feature makes it severable at any point along that length. The strip has a plurality of pairs of spaced apart electrical conductors extending longitudinally along the strip. Three such pairs labeled 43, 45, and 47 are shown in FIG. 2. These pairs of conductors are embedded in a self-limiting conductive material such as those described in the aforementioned U.S. patents. This material is labeled 49 and is in contact with and forms a heat generating zone between at least the conductors of each pair. It should be appreciated that although three pairs of conductors are shown, a fewer or a greater number could be used depending upon the required heat output of the baseboard heater and depending upon the electrical properties of the self-limiting conductive material 49 between the pair of conductors. A pair of bus conductors 51 are disposed in a block of insulative material 53 at the base of baseboard heater 11. These power bus conductors also extend longitudinally the length of strip 11 and are insulated from the electrically conducted material 49 by insulation 53. An additional layer 55 of insulative material is extruded around conductive material 49 and insulative block 53 to insulate and protect the electrical components of the baseboard heater strip 11. Of course, insulation 53 need not be a separate piece from layer 55. It can be extruded as an integral part of layer 55 in a single step. It should be appreciated that the layer 55 is an electrically insulative jacket which longitudinally covers conductors 43, 45, 47 and 51 and the self limiting conductive materials 49. Conductors 43, 45 and 47 are electrically connected in parallel as shown by the phantom lines in FIG. 2 to power bus wires 51 so that an electrical potential is applied between the conductors of each pair. Each pair of conductors forms a heat generating zone between the conductors of that pair. For example, the conductors of pair 43 form a heat generating zone 43A (FIG. 3) between those conductors. Likewise, conductive zones 45A and 47A are formed between the conductors of pairs 45 and 47. In addition, since self-limiting conductive material is disposed between the pairs of conductors, additional heat generating zones are formed between conductors of adjacent pairs. These zones are labeled 57 and 59 in FIG. 3. As a result of this structure, application of power to bus conductors 51 results in the generation of heat in the five heat generating zones shown in FIG. 3. Additional zones can of course be created by increasing the height of strip 11 and increasing the numbers of pairs of conductors. It should be appreciated that the self-limiting conductive material 49 as described and shown in the aforementioned U.S. patents has the property that as the temperture of the strip increases at a specific point, the resistance between adjacent pairs of conductors increases, which reduces the current and hence the power generated since the power equals the square of the voltage over the resistance at any particular point along strip 11. Likewise, as the temperature of the strip decreases (as would occur in an area of increased heat losss) the resistance decreases and the heat output from strip 11 increases in proportion at that point.

Figure 4:
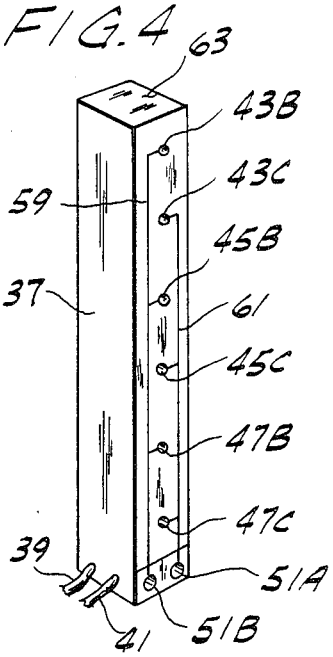
FIG. 4 is a perspective view illustrating a connector block for use with the baseboard heating system of the present invention.

Connector block 37 (FIG. 4) includes a set of terminals 51A and 51B for receiving the power conductors 51 from strip 11 and terminals 43B and 43C, 45B and 45C, 47B and 47C for receiving the conductors of conductor pairs 43, 45 and 47. The connector block also includes conductors 59 and 61 for making electrical connection between the power conductors 51 and the pairs of heat generating conductors 43, 45 and 47. These terminals and conductors are mounted in an insulative block 63. Teminals 51A and 51B are electrically connected to wires 39 and 41 (FIGS. 1 and 4) for making electrical connection to a power source. It should be appreciated that similar terminals are located on the opposite side of connector block 37 for making electrical connection between adjacent sections of strip 11. In the event that a connector block such as block 37 were used to terminate a strip, then the block would need only the terminals shown in FIG. 4.

In view of the above, it will be seen that the various objects and features of the present invention are achieved and other advantageous results obtained. It will be apparent to those skilled in the art that numerous modifications can be made to the apparatus and system and method shown herein without departing from the scope of the invention, as defined in the appended claims.

What is claimed is:

1. The method of heating a room comprising the steps of:

disposing a self-regulating heat producing strip along each wall, said strip including at least one pair of spaced apart electrical conductors extending longitudinally along each wall and spaced therefrom, self-limiting conductive material in physical contact with and forming a heat generating zone between the conductors, and an electrically insulative jacket longitudinally covering the conductors and the self-limiting conductive material; and applying a voltage across the conductors to generate heat in the strip.

2. The method as set forth in claim 1 wherein the strip extends substantially the entire length of the base of each wall.

3. The method as set forth in claim 1 wherein the disposing step includes the steps of severing a desired length of strip from a roll of such strip, the strip being severable at any point along the roll, and mounting the severed strip along the base of at least one wall.

4. The method as set forth in claim 3 wherein the desired length of strip corresponds in length to the base of the wall on which it is to be mounted.

5. The method as set forth in claim 1 wherein the heat output at points along the strip varies directly with the heat losses at those points.

6. The method as set forth in claim 5 wherein heat output of the strip is reduced at those points where the strip is at least partially obscured by an object such as a piece of furniture.

* * * * *